US006202731B1

(12) United States Patent
Rulon

(10) Patent No.: US 6,202,731 B1
(45) Date of Patent: Mar. 20, 2001

(54) PITCH ADJUSTMENT DIVIDER FOR VENETIAN BLINDS

(76) Inventor: John D. Rulon, 1054 Rutherford Rd., Rutherford, CA (US) 94573

( * ) Notice: Subject to any disclaimer, the term of this patent is extended or adjusted under 35 U.S.C. 154(b) by 0 days.

(21) Appl. No.: 09/592,840

(22) Filed: Jun. 13, 2000

(51) Int. Cl.[7] ..... E06B 9/38
(52) U.S. Cl. ..... 160/178.1 R; 160/115
(58) Field of Search ..... 160/178.1 R, 173 R, 160/176.1 R, 177 R, 115, 168.1 R, 174 R, 107

(56) References Cited

U.S. PATENT DOCUMENTS

| | | | | |
|---|---|---|---|---|
| 2,818,113 | * | 12/1957 | Reichel | 160/115 |
| 4,940,070 | * | 7/1990 | Warden | 160/115 X |
| 5,205,335 | * | 4/1993 | Horton et al. | 160/115 |
| 5,402,840 | * | 4/1995 | Jortner et al. | 160/115 |

* cited by examiner

*Primary Examiner*—David M. Purol

(74) *Attorney, Agent, or Firm*—Rodger H. Flagg

(57) ABSTRACT

A tilt adjustment device includes tilt adjustment assemblies mounted on, and actuated by, a multi-sided bar, the entire device being mountable on a conventional venetian blind assembly for the purpose of providing separate adjustment of the venetian blind slats above the tilt adjustment device and those below the tilt adjustment device. The multi-sided bar passes through an aperture is a screw gear of the tilt adjustment assembly. The screw gear when rotated engages toothed gears in a slotted tilt adjuster, and the screw gear and the hexagonal bar are retained together by a housing. The tilt adjustment assembly and hexagonal bar can be easily attached to an existing venetian blind assembly, such as a mini-blind assembly. The device needs to be installed only once, and may be selectively raised and lowered on the ladder chords to suit the needs of the user. In use, the device can be vertically positioned and the slat pitch below the device can be adjusted in two easy motions. First, the device as a whole is positioned at the desired elevation. Then, the hexagonal bar is manually rotated to cause adjustment of the pitch of the slats located below the device. The operation of the hexagonal bar to adjust the slats is performed in a similar way to that which can be used to adjust an ordinary venetian blind, and is therefore intuitive and straightforward.

20 Claims, 4 Drawing Sheets

PITCH ADJUSTMENT DIVIDER FOR VENETIAN BLINDS

FIELD OF THE INVENTION

The present invention relates to window coverings of the type known as venetian blinds. More particularly, the invention relates to a pitch adjustment divider for venetian blinds.

BACKGROUND OF THE INVENTION

The types of window coverings known as venetian blinds are themselves well known in the art. Modifications to such venetian blinds are also known, and examples of same are discussed below.

U.S. Pat. No. 5,402,840 to Jortner et al. is directed to a venetian blind tilt divider. In this patent, slats of blinds are divided into upper and lower portions by the installation of a divider. The divider must be attached individually to each ladder chord. Each divider must be removed and reattached to reposition the divider vertically. This divider offers only a few changes of pitch of the slats.

U.S. Pat. No. 5,205,335 to Horton et al. is directed to a method and apparatus for opening a portion of a venetian window blind while selectively closing another portion. This patent is directed to a system for modifying existing venetian blinds so as to maintain a desired portion of window slats open while simultaneously maintaining the remaining portion in a closed position. A clip is used in this system. The divider must be attached individually to each ladder chord. Each divider must be removed and reattached to reposition the divider vertically. This divider offer only a few changes of pitch of the slats.

U.S. Pat. No. 4,940,070 to Warden is directed to a bifold privacy miniblind. In this patent, individual blinds are supported by a string ladder support system on each side. A second control cord must be added to an existing venetian blind. The vertical location of the division cannot be easily changed.

U.S. Pat. No. 5,845,691 to Gaines teaches a venetian blinds control system. In this system, the upper half of blinds can be rotated independently. A second ladder cord and control must be added to an existing venetian blind. The vertical location of the division cannot be easily changed.

U.S. Pat. No. 4,621,672 to Hsu teaches a mechanism for a window blind. The blind includes horizontal slats and a regulating mechanism. When the upper slats are opened, the lower slats can be closed and vice versa. A second ladder cord and control must be added to an existing venetian blind. The vertical location of the division cannot be easily changed.

U.S. Pat. No. 4,697,630 to Rude teaches a tilt mechanism for venetian blinds. In this patent, a tilt mechanism uses band brakes having ends, and ladder cords being attached to these ends. This apparatus does not split the blind into upper and lower portions.

U.S. Pat. No. 5,119,868 to Werner teaches a venetian blind with a three-position tilt adjustment. In this patent, the slats are divided into upper and lower sections, the tilt of the slats being separately adjusted for each section. A second ladder chord and control are required. The vertical location of the division cannot be easily changed.

U.S. Pat. No. 1,229,523 teaches an adjustable closure for a window using bearings and flexible supporting guides. This apparatus differs significantly from applicant's invention.

It remains a problem in the art, however, to provide a venetian blind adjustment device which is easily attached to existing Venetian blinds, which can be replaced vertically without having to remove the device from the ladder chords, and which provides an adjusting divider so that two different portions of the venetian blinds can be adjusted differently.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a venetian blind adjustment device which is easily attached to existing venetian blinds, which can be relocated vertically without having to remove the device from the ladder chords, and which provides an adjusting divider so that two different portions of the venetian blinds can be adjusted differently.

More specifically, the tilt adjustment device includes tilt adjustment assemblies mounted on, and actuated by, a hexagonal bar, the entire device being mountable on a conventional venetian blind assembly for the purpose of providing separate adjustment of the venetian blind slats above the tilt adjustment device and those below the tilt adjustment device. The hexagonal bar passes through a screw gear of the tilt adjustment assembly. The screw gear when rotated engages slots in a slotted tilt adjuster, and the screw gear and the hexagonal bar are retained together by a housing. In use, the tilt adjustment assembly and hexagonal bar can be attached to an existing venetian blind assembly, such as a mini-blind assembly. The attachment to the venetian blind occurs only once during installation by snapping each vertical ladder chord through the slot of the slotted tilt adjuster.

After the tilt adjustment assemblies are attached to chords of the Venetian blind assembly, the device as a whole can be positioned vertically by lifting the device to the desired elevation while the device is attached to the venetian blind. Then, the hexagonal bar is manually rotated to cause adjustment of the slats. The operation of the hexagonal bar to adjust the slats is performed in a similar way to the operation of the vertical bar typically used to adjust an ordinary venetian blind, and is therefore intuitive and straightforward.

The device may be easily moved to a new vertical location by lifting the hexagonal bar which lifts each slotted tilt adjuster simultaneously. The device does not need to be removed from the ladder chords as required by the cited prior art.

The pitch of the venetian blind below the device is adjusted by twisting the hexagonal bar. Partial rotation of the hexagonal bar simultaneously turns each tilt adjuster, which in turn causes the shortening or lengthening of each vertical ladder chord to change the pitch of the slats located below the device.

Other objects and advantages of the present invention will be more readily apparent from the following detailed description when read in conjunction with the accompanying drawings.

DETAILED DESCRIPTION OF THE INVENTION

Figure 1:
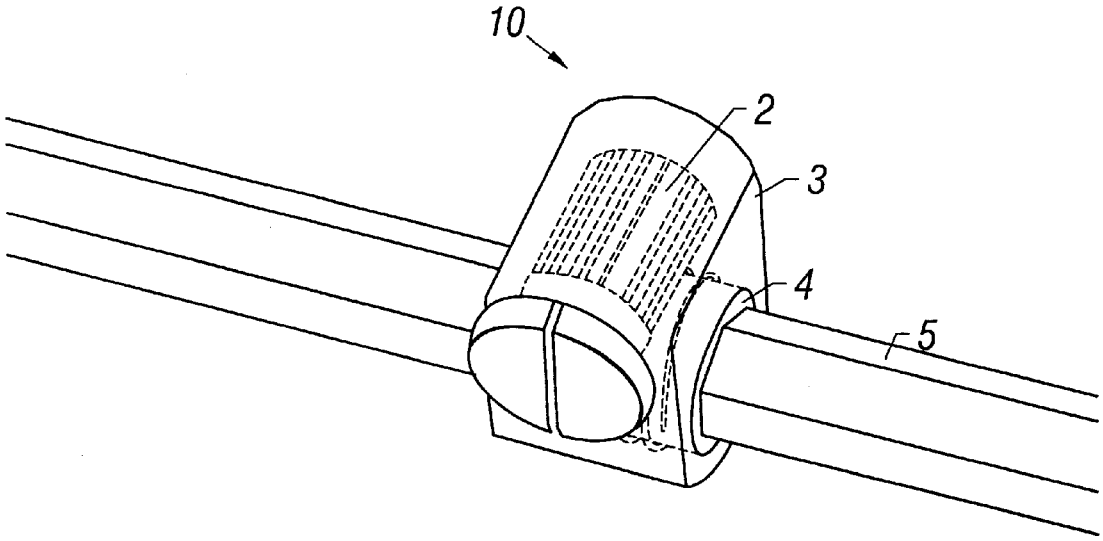
FIG. 1 is a perspective view of a tilt adjustment assembly and operating bar according to the present invention, and schematically showing a housing thereof in phantom view.

As shown in FIG. 1, a tilt adjustment assembly 10 is mounted on, and actuated by, a multi-sided bar 5. The multi-sided bar 5 is preferably a hexagonal bar. The multi-sided bar 5 passes through a worm screw gear 4 of the tilt adjustment assembly 10. The worm screw gear 4, when rotated, engages toothed gears in a slotted tilt adjuster 2. The screw gear 4 and the hexagonal bar 5 are retained together by a housing 3. The housing 3 is shown in phantom or semi-transparent view in FIG. 1.

The housing 3 has a first aperture 12 sized to rotatably receive a portion of the slotted tilt adjuster 2 therein. A second aperture 14 is positioned below and perpendicular to the first aperture 12, and is sized to rotatably receive a screw gear 4 therein. The threads 6 on the screw gear 4 engage teeth 7 radially disposed about the slotted tilt adjuster 2, so that rotation of the screw gear 4 causes rotation of the teeth 7 on the slotted tilt adjuster 2. A multi-sided aperture 16 extends through the screw gear 4 in concentric alignment with the teeth 7. The multi-sided aperture 16 is sized to slidably receive a multi-sided bar 5 there-through.

In use, the tilt adjustment assembly 10 and hexagonal bar 5 can be attached to an existing venetian blind assembly, such as a mini-blind assembly. The attachment to the venetian blind occurs only once during installation.

After the tilt adjustment assemblies are attached to chords of the venetian blind assembly, the device as a whole can be positioned vertically by lifting the device to the desired elevation while the device is attached to the venetian blind. Then, the hexagonal bar 5 is manually rotated to cause adjustment of the slats. The operation of the hexagonal bar 5 to adjust the slats is performed in a similar way to the operation of the vertical bar typically used to adjust an ordinary venetian blind, and is therefore intuitive and straightforward.

The device may be easily moved to a new vertical location by lifting the multi-sided bar 5 which lifts each slotted tilt adjuster 2 simultaneously. The device does not need to be removed from the ladder chords 22, 24 as required by the cited prior art.

Figure 5:
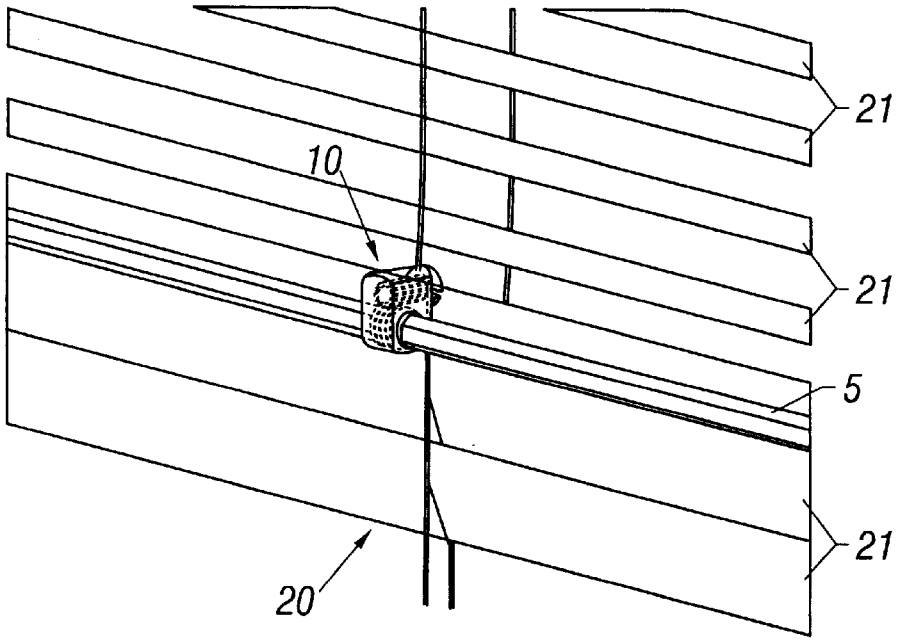
FIG. 5 is a perspective view of the tilt adjustment assembly and operating bar of FIG. 1 according to the present invention mounted in place on a venetian blind.
Figure 6:
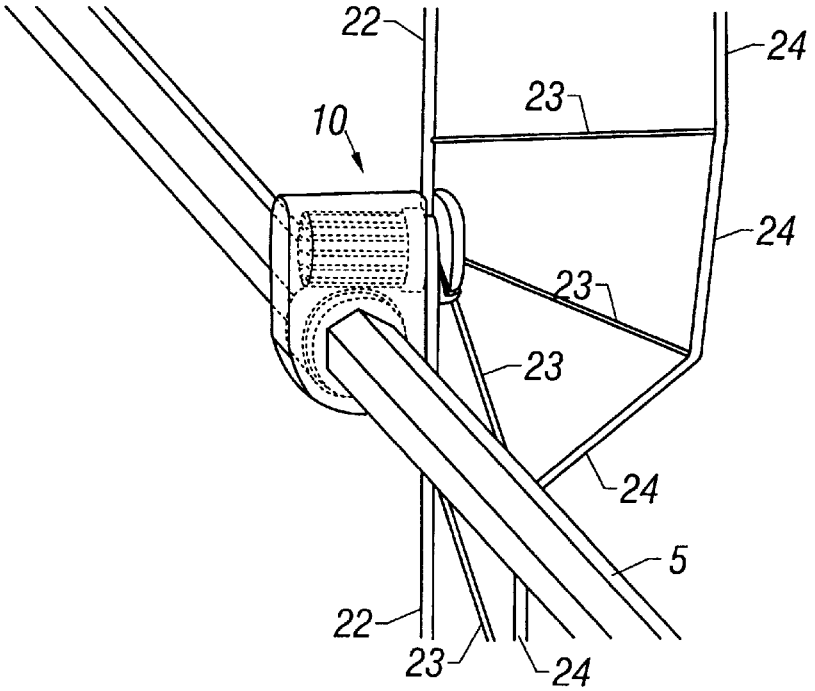
FIG. 6 is a perspective view of the tilt adjustment assembly and operating bar of FIGS. 1 and 5 according to the present invention, shown mounted on individual chords of the Venetian blind, showing operation of the tilt arrangement.

The pitch of the venetian blind assembly 20 below the housing 3 is adjusted by rotating the multi-sided bar 5. Partial rotation of the multi-sided bar 5 simultaneously turns each tilt adjuster 2, which in turn causes the shortening or lengthening of each vertical ladder chord 22, 24 to change the pitch of the slats 21 located below the device, as shown in FIG. 6, and further described below. Then, the multi-sided bar 5 is manually rotated to cause adjustment of the slats 21 (as shown in FIG. 5 below).

Figure 4:
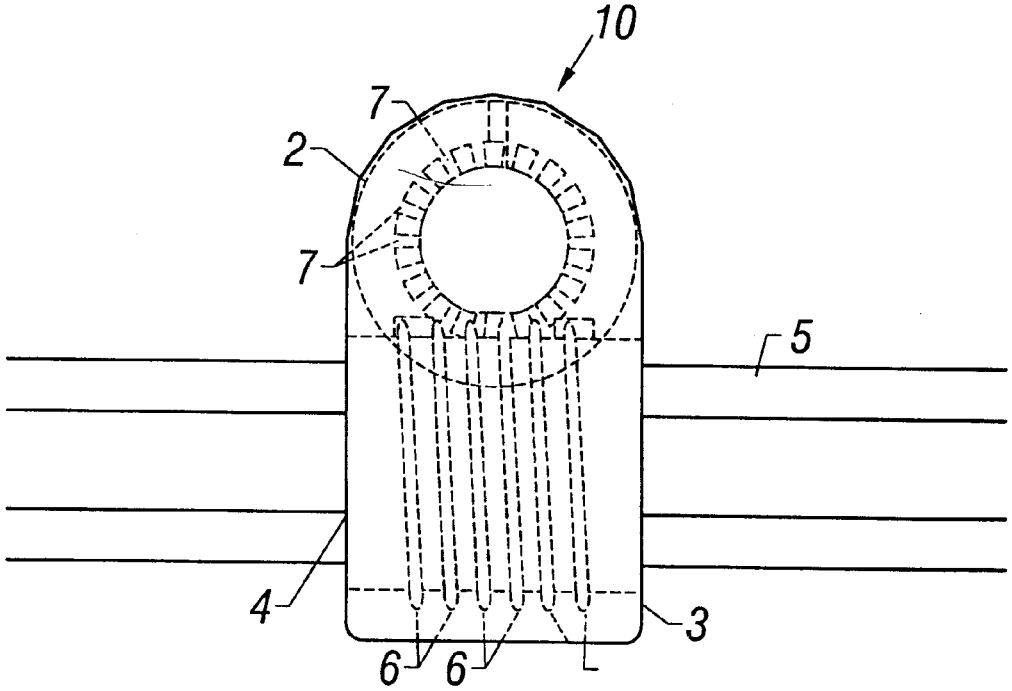
FIG. 4 is a front elevational view of the tilt adjustment assembly of FIGS. 1 and 2, wherein the housing is schematically shown in phantom outline.

It will be understood that the screw gear 4 can be mounted for rotation within the housing 3 in any known manner, such as by roller bearings, journal bearings, or simply by frictional sliding engagement. The threaded portion of the screw gear 4 (i.e., the threads 6 as shown in FIG. 4) engages with the toothed gears 7 (also shown in FIG. 4) of the slotted tilt adjuster 2 in a worm-type gear arrangement.

Also, while the multi-sided bar 5 is shown as having a hexagonal shape, this is a matter of choice and can include other multi-sided shapes, including regular or irregular polygonal cross-sections, regular or non-regular curved cross-sections, and so on. The multi-sided bar 5 preferably has a uniform cross-section along its length, to allow the user to adjustably position the screw gear along the length of the bar 5 to align the screw gear with the vertical ladder chords 22, 24 on the venetian blind assembly 20. This enables a tilt adjuster assembly 10 to be positioned in relation to each ladder chord 22, and to align each tilt adjuster assembly 10 in relation to its adjacent ladder chord 22.

Figure 2:
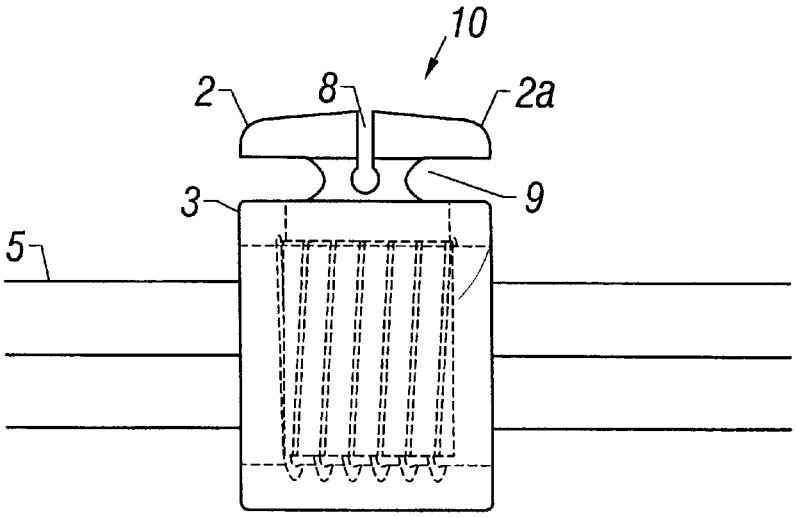
FIG. 2 is a top elevational view of the device of FIG. 1, also schematically showing a housing thereof in phantom view.

FIG. 2 shows a top elevational view of the tilt adjustment assembly 10 of FIG. 1. In this view, the housing 3 is also schematically shown in phantom view for the sake of clarity. As seen in FIG. 2, the slotted tilt adjuster 2 has an enlarged head portion 2a which has a keyhole-shaped slot 8 formed therein. The keyhole-shaped slot 8 provides a close fit which permits insertion of a vertical venetian blind chord therein.

It should be noted that the vertical ladder chord 22, 24 is typically thicker than the horizontal ladder chords 23. When the device is installed, the vertical cord 22 is forced through the slot 8. During operation, the vertical chords 22 will not normally slip back through the slot 8, while the horizontal ladder chords 23 are thinner and can slip easily through the slot 8, when the slot 8 is aligned parallel to the vertical cord 22.

Figure 3:
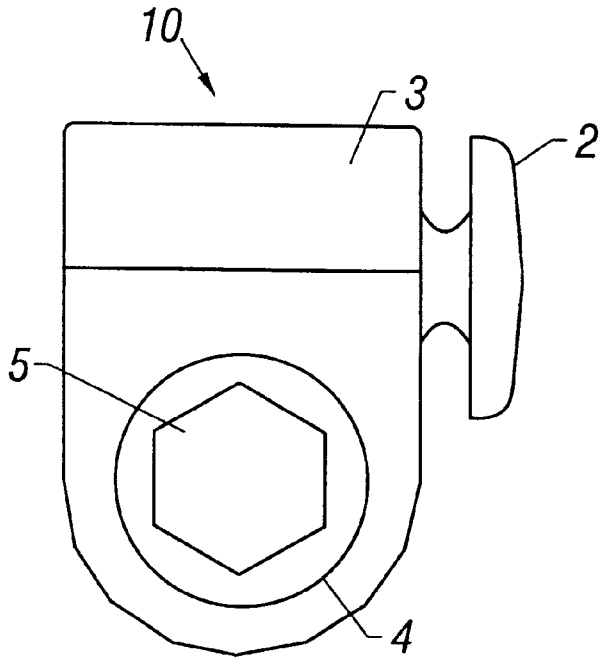
FIG. 3 is a side elevational view of the tilt adjustment assembly of FIGS. 1 and 2, wherein the housing is shown in solid outline.

As seen in FIGS. 1 and 2, the keyhole-shaped slot 8 extends in a straight line along the outer face portion of the slotted tilt adjuster 2. The slotted tilt adjuster 2 has a neck portion 9 which is adjacent to the enlarged head portion 2a. When the multi-sided rod 5 is rotated, the screw gear 4 is likewise rotated, which caused the slotted tilt adjuster 2 to also be rotated. The vertical ladder chord 22 located in the slot 8 is wound about the neck portion 9 of the slotted tilt adjuster 2, which changes the pitch of the slats 21 located below the tilt adjustment assembly 10. The housing 3 is shown in side elevational view in FIG. 3, and the end of the hexagonal bar 5 of the tilt adjustment assembly 10 is shown slidably received within the screw gear 4.

Details of the engaging portions of the screw gear 4 and the slotted tilt adjuster 2 are shown in FIG. 4, which is a front elevational view of the tilt adjustment assembly 10 of FIGS. 1 and 2. In this view, for the sake of clarity, the housing 3 is schematically shown in phantom outline. The screw gear 4 has a plurality of threads 6 shown in FIG. 4, which preferably are formed by a single helical ridge. Alternatively, a plurality of interleaved helical threads could be used to form the threads 6 in a more complex arrangement, and all such variations are contemplated as being within the scope of the present invention. The threads 6 drive teeth 7 of the slotted tilt adjuster 2 as shown in FIG. 4.

FIG. 5 is a perspective view of the tilt adjustment assembly 10 and hexagonal bar 5 of according to the present invention, mounted in place on a venetian blind assembly 20. The venetian blind assembly 20 includes a plurality of slats 21 and a plurality of vertical chords (22, 24 as shown in FIG. 6) and a plurality of horizontal chords (23, as shown in FIG. 6). In FIG. 5, a portion of the venetian blind assembly 20 above the tilt adjustment assembly 10 is in an open position, and the portion of the venetian blind assembly 20 below the tilt adjustment assembly 10 is in a closed position.

FIG. 6 is a perspective view of the tilt adjustment assembly 10 and hexagonal bar 5 of according to the present invention, mounted in place on the venetian blind assembly 20 as shown in FIG. 5. The venetian blind assembly 20 includes the plurality of slats 21 (not shown for clarity in FIG. 6) and the plurality of vertical chords 22, 24 and the plurality of horizontal chords 23, 23. As seen in FIG. 6, a portion of the vertical chord 22 (which is a tilt adjusting ladder chord) is retained within the keyhole-shaped slot 8 (shown in FIG. 2) and is twisted by the rotation of the slotted tilt adjuster 2, thereby deforming the venetian blind assembly 20 as shown in FIG. 6, thereby bringing the slats 21 (shown in FIG. 5) into a closed orientation.

The device according to the present invention adjusts the pitch of the venetian blinds slats 21 by simultaneously shortening the working length of each of the tilt adjusting ladder chords 22 on one side of the venetian blind assembly 20. This is accomplished by manual rotation of the multi-sided bar 5. Rotation of each of the tilt adjustment assemblies 10 wraps each of the respective tilt adjusting ladder chords 22 around the neck portion 9, thereby shortening each of the respective tilt adjusting ladder chords 22 by the same amount.

When the slotted tilt adjusters 2 of the tilt adjustment assemblies 10 are aligned vertically, i.e. with the keyhole-shaped slots 8 parallel to the respective tilt adjusting ladder chords 22, the entire device can be positioned or re-positioned relatively easily by simply lifting or lowering the multi-sided bar 5. The vertical ladder chord 22 can be inserted into the keyhole-shaped slot 8 only by being forced, and is thereby retained therein.

Installation of the device on a venetian blind only needs to be done once! When installed, the device can remain attached and be repositioned vertically on the venetian blind at any time without the need to detach and reinstall applicant's device.

Figure 7:
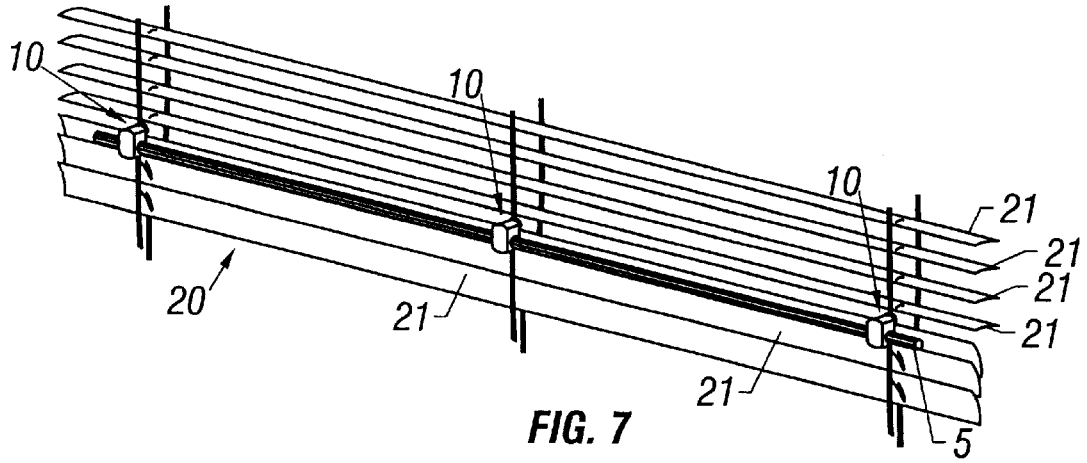
FIG. 7 is a perspective view showing a plurality of tilt adjustment assemblies as shown in FIGS. 1–4, and mounted on the operating bar as shown in FIGS. 1 and 5, the entire assembly being mounted in place on a venetian blind, wherein slats of the venetian blind are open above the tilt arrangement and are closed below the tilt arrangement.

FIG. 7 shows in perspective view a plurality of tilt adjustment assemblies 10 (of the type shown in FIGS. 1–4) mounted on the hexagonal bar 5, each of the tilt adjustment assemblies 10 being connected on a respective one of the vertical chords 22. In this figure, the slats 21 of the venetian blind assembly 20 are open above the tilt adjustment assemblies 10 and are closed below the tilt adjustment assemblies 10.

Figure 8:
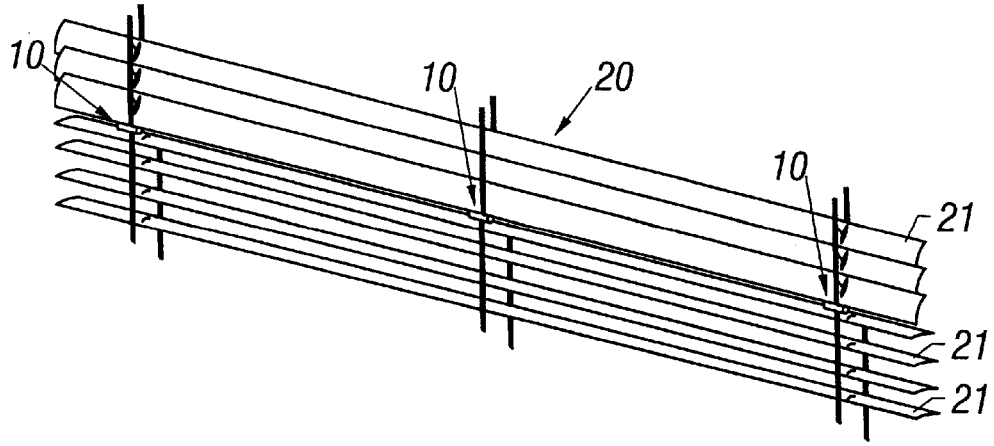
FIG. 8 is a perspective view similar to FIG. 7, wherein slats of the venetian blind are closed above the tilt arrangement and are open below the tilt arrangement.

FIG. 8 is a perspective view similar to FIG. 7, and shows in perspective view a plurality of tilt adjustment assemblies 10 (of the type shown in FIGS. 1–4 ) mounted on the hexagonal bar 5, each of the tilt adjustment assemblies 10 being connected on a respective one of the vertical chords 22. In this figure, the slats 21 of the venetian blind assembly 20 are closed above the tilt adjustment assemblies 10 and are open below the tilt adjustment assemblies 10.

Figure 9:
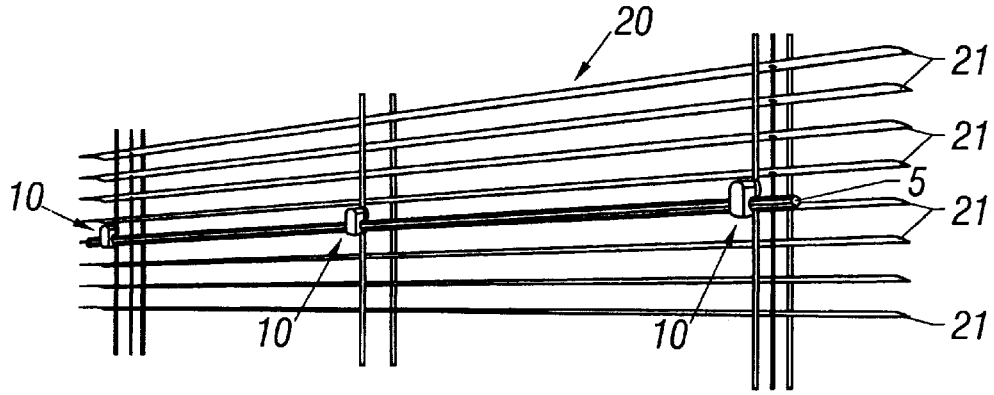
FIG. 9 is a perspective view similar to FIG. 7, wherein slats of the venetian blind are open both above the tilt arrangement and also below the tilt arrangement.

FIG. 9 is a perspective view similar to FIG. 7, and shows in perspective view a plurality of tilt adjustment assemblies 10 (of the type shown in FIGS. 1–4 ) mounted on the hexagonal bar 5, each of the tilt adjustment assemblies 10 being connected on a respective one of the vertical chords 22. In this figure, the slats 21 of the venetian blind assembly 20 are open both above the tilt adjustment assemblies 10 and below the tilt adjustment assemblies 10.

As shown in FIG. 9 by the double-headed arrow labeled V, the tilt adjustment assemblies 10 and the hexagonal bar 5 can be lifted or lowered while remaining attached to the vertical Venetian blind ladder chords 22.

The invention being thus described, it will be evident that the same may be varied in many ways. Such variations are not to be regarded as a departure from the spirit and scope of the invention and all such modifications are intended to be included within the scope of the claims.

I claim:

1. A pitch adjustment apparatus for selective attachment to a chord assembly of an existing venetian blind assembly, to adjust the pitch of a plurality of slats located below the pitch adjustment apparatus, which comprises:

a) at least two pitch adjustment housings, each with a first aperture and a second aperture positioned below the first aperture, the second aperture perpendicularly aligned below the first aperture;

b) a slotted pitch adjuster positioned within the first aperture in the pitch adjustment housing, each pitch adjuster with a slot extending past a first end, the slot aligned with a neck portion extending about the outer periphery of the pitch adjuster near the first end, and positioned in alignment with one of the existing chords of said venetian blind assembly, each pitch adjuster with a plurality of teeth extending about the outer periphery, from proximity of the neck portion to a distal end;

c) a screw gear positioned within the second aperture of each of the pitch adjustment housings, each screw gear with gear threads engaging the teeth on the pitch adjuster in a worm gear arrangement, each screw gear further having a multi-sided aperture extending through the screw gear in concentric alignment with the gear threads;

d) a multi-sided rod slidably received through the multi-sided aperture in each of the screw gears, the multi-sided rod extending through each of the screw gears located in each of the pitch adjustment housings;

wherein rotation of the multi-sided rod provides a pitch adjustment of all the venetian blind slats located below the pitch adjustment housing, independent of the orientation of the pitch adjustment of the venetian blind slats located above the pitch adjustment housing.

2. The pitch adjustment apparatus of claim 1, wherein the multi-sided aperture in the screw gear is a hexagonal aperture, and the multi-sided rod extending through the multi-sided aperture is a hexagonal rod extending through each of the pitch adjustment housings.

3. The pitch adjustment apparatus of claim 1, wherein the slot in the pitch adjuster is sized to receive a cord from the Venetian blind assembly, and the cord is rotated about the groove in the pitch adjuster as the pitch adjuster is rotated by the rotation of the multi-sided rod.

4. The pitch adjustment apparatus of claim 1, wherein more than two existing chords are positioned on a venetian blind assembly having a plurality of slats, and a pitch adjustment housing is aligned with each of the existing chords.

5. The pitch adjustment apparatus of claim 1, wherein the slot in the pitch adjuster is positioned to face towards a window.

6. The pitch adjustment apparatus of claim 1, wherein the pitch adjustment apparatus is adjusted to selectively open and close the plurality of slats below the pitch adjustment apparatus.

7. The pitch adjustment apparatus of claim 1, wherein each slot in the slotted pitch adjuster includes a keyway type slot which is selectively raised and lowered upon the existing ladder chords of the existing venetian blind assembly, to selectively position the pitch adjustment housing without removal of the slotted pitch adjuster from the existing ladder chords.

8. The pitch adjustment apparatus of claim 1, wherein there are at least three pitch adjustment housings, each having a slotted pitch adjuster and a screw gear, with the multi-sided rod slidably received through all of the screw gears.

9. A pitch adjustment apparatus for selective attachment to at least three existing chord assemblies of an existing venetian blind assembly, to selectively adjust the pitch of a plurality of slats located below the pitch adjustment apparatus, which comprises:

a) at least three pitch adjustment housings, each with a first aperture and a second aperture positioned below the first aperture, the second aperture perpendicularly aligned in relation to the first aperture;

b) a slotted pitch adjuster positioned within the first aperture of each of the pitch adjustment housings, each slotted pitch adjuster with a slot extending past a first end, the slot aligned with a neck portion extending about the outer periphery of the pitch adjuster near the first end, and the slot positioned in alignment with one of the existing chords of said venetian blind assembly, each pitch adjuster with a plurality of teeth extending about the outer periphery of the slotted pitch adjuster, from proximity to the neck portion on the first end to a distal end;

c) a screw gear positioned within the second aperture of each of the pitch adjustment housings, each screw gear with gear threads engaging the teeth on the pitch adjuster in a worm gear arrangement, each screw gear further having a multi-sided aperture extending through the screw gear in concentric alignment with the gear threads;

d) a multi-sided rod slidably received through the multi-sided aperture in each of the screw gears located in each of the pitch adjustment housings;

wherein rotation of the multi-sided rod provides a pitch adjustment of all the venetian blind slats located below the pitch adjustment housing.

10. The pitch adjustment apparatus of claim 9, wherein the multi-sided aperture in the screw gear is a hexagonal aperture, and the multi-sided rod extending through the multi-sided aperture is a hexagonal rod extending through each of the pitch adjustment housings.

11. The pitch adjustment apparatus of claim 9, wherein the slot in the pitch adjuster is sized to receive a cord from the venetian blind assembly, and the cord is rotated about the neck portion in the pitch adjuster as the pitch adjuster is rotated by the rotation of the multi-sided rod.

12. The pitch adjustment apparatus of claim 9, wherein a bushing is used to secure the screw gear in the second aperture in the housing.

13. The pitch adjustment apparatus of claim 9, wherein the slot in the pitch adjuster is positioned to face towards a window.

14. The pitch adjustment apparatus of claim 9, wherein the pitch adjustment apparatus is adjusted to selectively open and close the plurality of slats below the pitch adjustment apparatus.

15. The pitch adjustment apparatus of claim 9, wherein each slot in the slotted pitch adjuster includes a keyway type slot which is selectively raised and lowered upon the existing ladder chords of the existing Venetian blind assembly, to selectively position the pitch adjustment housing without removal of the slotted pitch adjuster from the existing ladder chords.

16. A pitch adjustment apparatus for selective attachment to an existing vertical chord assembly of a Venetian blind apparatus, to selectively adjust the pitch of a plurality of slats located below the pitch adjustment apparatus, which comprises:

a) at least two pitch adjustment housings, each with a first aperture and a second aperture positioned below the first aperture, the second aperture perpendicularly aligned in relation to the first aperture;

b) a slotted pitch adjuster positioned within the first aperture of each of the pitch adjustment housings, each slotted pitch adjuster with a slot extending past a first end, the slot aligned with a neck portion extending about the outer periphery of the pitch adjuster near the first end, and positioned in alignment with one of the existing chords of said venetian blind assembly, each pitch adjuster with a plurality of teeth extending about the outer periphery of the slotted pitch adjuster, from proximity to the neck portion on the first end to a distal end; the slot in the pitch adjuster is sized to receive a vertical cord from the venetian blind assembly, and the cord is rotated about the neck portion in the pitch adjuster as the pitch adjuster is rotated by the rotation of the hexagontal rod;

c) a screw gear positioned within the second aperture of each of the pitch adjustment housings, each screw gear with gear threads engaging the teeth on the pitch adjuster, each screw gear further having a hexagonal aperture extending through the screw gear in concentric alignment with the gear teeth;

d) a hexagonal rod slidably received through the hexagonal aperture in each of the screw gears, the hexagonal rod extending through each of the screw gears located in each of the pitch adjustment housings;

wherein rotation of the hexagonal rod provides a pitch adjustment of all the venetian blind slats located below the pitch adjustment housing.

17. The pitch adjustment apparatus of claim 16, wherein a bushing is used to secure the screw gear in the second aperture in the housing.

18. The pitch adjustment apparatus of claim 16, wherein the slot in the pitch adjuster is positioned to face towards a window.

19. The pitch adjustment apparatus of claim 16, wherein the pitch adjustment apparatus is adjusted to selectively open and close the plurality of slats below the pitch adjustment apparatus.

20. The pitch adjustment apparatus of claim 16, wherein each slot in the slotted pitch adjuster includes a keyway type slot which is selectively raised and lowered upon the existing ladder chords of the existing Venetian blind assembly, to selectively position the pitch adjustment housing without removal of the slotted pitch adjuster from the existing ladder chords.

* * * * *